United States Patent [19]

Horton

[11] 4,185,694

[45] Jan. 29, 1980

[54] MARINE RISER SYSTEM

[75] Inventor: Edward E. Horton, Portuguese Bend, Calif.

[73] Assignee: Deep Oil Technology, Inc., Irvine, Calif.

[21] Appl. No.: 831,379

[22] Filed: Sep. 8, 1977

[51] Int. Cl.[2] ..... E21B 7/12

[52] U.S. Cl. ..... 166/350; 166/352; 175/6

[58] Field of Search ..... 175/5, 7, 8, 9; 166/0.5, 0.6, 350, 359, 367, 352, 354; 114/264, 265; 9/8 R, 8 P

[56] References Cited

U.S. PATENT DOCUMENTS

| | | | |
|---|---|---|---|
| 3,142,343 | 7/1964 | Otteman et al. | 175/7 |
| 3,163,239 | 12/1964 | DeVries et al. | 175/7 |
| 3,440,671 | 4/1969 | Smulders | 9/8 P |
| 3,516,488 | 6/1970 | Joubert et al. | 175/7 X |
| 3,563,042 | 2/1971 | Ryan | 175/7 X |
| 3,601,187 | 5/1969 | Tidwell | 175/7 X |
| 3,602,319 | 8/1971 | Graham et al. | 166/0.5 X |
| 3,605,413 | 9/1971 | Morgan | 166/0.5 X |
| 4,053,022 | 10/1977 | Mercier | 175/7 X |
| 4,126,183 | 11/1978 | Walker | 166/364 X |

*Primary Examiner*—James A. Leppink
*Assistant Examiner*—Richard E. Favreau
*Attorney, Agent, or Firm*—Poms, Smith, Lande & Rose

[57] ABSTRACT

A marine riser system is provided which extends between a floating offshore platform and well means in a seabed formation and which has riser end portions connected in novel manner to the floating platform and to wellhead structure at the well hole. Each end portion of the riser is adapted to yield axially, laterally, and rotatively during movement of the riser relative to the platform and to the wellhead structure. Each end portion of the riser is provided with fulcrum or pivot contacts with hawse pipe carried by the platform and with hawse pipe or casing means provided in the wellhead structure. Bending stresses at the riser end portions are reduced at the platform and at the wellhead structure.

9 Claims, 10 Drawing Figures

OFFSET
X
22
21
23
23
1.25 M/Sec.
25
25
39
24
27
27
32
26
30
26
0.55 M/Sec.

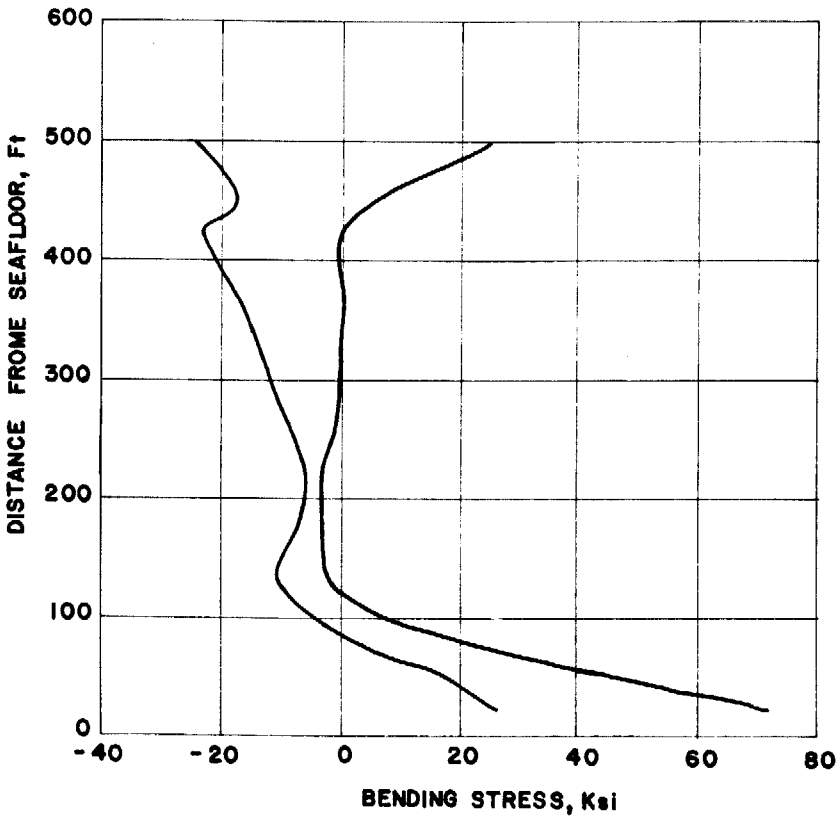
Fig. 4.
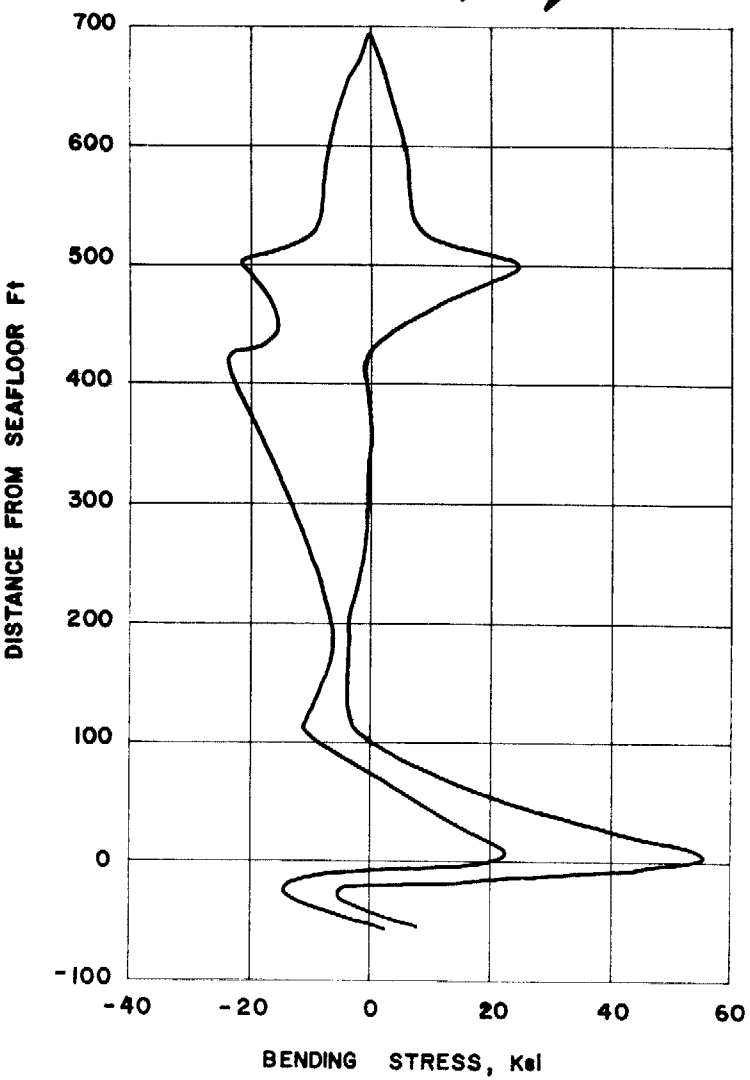
Fig. 5.
| | BENDING STRESS @ SEAFLOOR Ksi | | | | BENDING STRESS @ BOTTOM OF PONTOON, Ksi | | | |
|---|---|---|---|---|---|---|---|---|
| | CASE 1 | CASE 2 | CASE 3 | CASE 4 | CASE 1 | CASE 2 | CASE 3 | CASE 4 |
| FIXED SUPPORT | 44.7 | 56.3 | 28.5 | 32.9 | 33.1 | 18.4 | 8.1 | 67.0 |
| NON-FIXED SUPPORT | 34.8 | 44.8 | 25.0 | 26.0 | 26.8 | 13.3 | 4.5 | 57.0 |
Fig. 10.

MARINE RISER SYSTEM

BACKGROUND OF INVENTION

A riser pipe is used to connect a subsea wellhead structure at the sea floor with a floating platform maintained in position above the wellhead. The riser pipe is subjected to an infinite number of degrees of freedom of movement. Both upper and lower ends of the riser pipe are affected by movement of a floating platform. Load parameters acting on a riser pipe system include forces resulting from heave, pitch, roll, sway or surge, height and period of swell, specific gravity of fluid conducted within the riser, buoyancy means attached to the riser, current profile, offset of the platform from the axis of the well means, tension at the top of the riser, and the stiffness of the riser relative to rotation thereof and its vertical disposition.

The term "fixed" or "fixed connection" is used to identify a non-rotatable or non-bendable condition of a riser end portion about an axis perpendicular to the longitudinal axis of the pipe within a hawse pipe or well casing. The term "non-fixed" as used herein refers to a rotatable riser condition, that is, riser end portion are bendable at and within a hawse pipe or well casing.

Generally speaking, prior conventional riser constructions have provided a fixed connection to a wellhead at the seabed formation; the fixed connection initially being rigid and lately being in the form of a swivel means such as a ball joint or its equivalent so that when lateral bending forces acted on the riser pipe, the lower end of the riser pipe could pivotally adjust to displacement or movement of the pipe. The upper end of such prior risers were connected to the platform means by relatively complex riser tensioning systems which permitted the platform to move relative to the riser and at the same time maintain a desired tension on the riser. Thus, in some prior risers, the upper end of the riser and the platform means had relative movement longitudinally of the riser and often had a sliding relationship with the platform. In some further prior riser systems, the connection of the top end of the riser to the platform included a swivel arrangement which permitted the pipe to adjust relative to the platform as the platform became laterally displaced. In all such prior proposed risers with fixed end connections known to me, relatively severe bending stresses would be imparted to the riser pipe just above the wellhead structure and just below the platform. In addition, lateral movement of the platform means with respect to the wellhead caused a relative change in distance between the vertical position of the platform with respect to a fixed point on the seabed as evidenced by the angular rotation or displacement of the tethering lines and the change in vertical position of the top end of the riser. Any lateral displacement of the platform produces a change in tension and length of the anchor legs and of a riser pipe having at least one of its ends fixed.

In riser systems designed for deep water, it is desirable that the relative change in length between a riser extending from a well hole to a floating platform thereabove be minimized and that a construction and arrangement be used which would reduce bending stresses of the riser pipe adjacent to the seabed and adjacent to the platform as much as possible. Prior riser systems, with a fixed wellhead connection and a riser tensioned platform connection, would have been subjected to severe bending stresses at the above locations in the event of strong wind and wave currents.

SUMMARY OF INVENTION

The present invention relates to a marine riser system wherein ends of the riser system are non-fixedly relatively movably connected to the platform means and to the well means at the sea floor. The invention particularly relates to a riser system wherein the bending stresses imposed upon the riser pipe are significantly reduced by a novel means connecting ends of the riser pipe to the platform and to the well means.

The present invention contemplates a marine riser system wherein upper and lower ends of the riser pipe are protected from ocean currents and waves by housing the end portions in hawse pipe or in a well casing at the well means. The riser pipe is not fixedly connected to either the platform means or the well means; instead the riser pipe has its end portions received within hawse pipe for loose sliding relationship therein and also for spaced fulcrum or pivotal contact between the riser pipe means and the hawse pipe.

Generally speaking, each end of the riser pipe may be provided with one or more collar-like members in longitudinal spaced relation for fulcrum or pivot contact with internal surfaces of the hawse pipe or well casing. The invention contemplates that such relatively movable connection provides a significant reduction in bending stresses which may occur in the riser pipe adjacent the platform and adjacent the seabed.

It is therefore a primary object of the present invention to disclose a novel marine riser pipe system for particular use in deep offshore well operations.

An object of the present invention is to disclose a marine riser pipe system in which novel means are employed for connecting ends of the riser pipe system to the well means and to a floating platform.

Another object of the present invention is to disclose a riser pipe system in which an end portion of the riser pipe is non-fixedly relatively movably connected to the well means.

A further object of the present invention is to disclose a marine riser pipe system wherein novel means for connecting one end of the riser pipe system to well means includes hawse means or well casing means adapted to receive the lower riser end portion in such a manner as to permit relative sliding movement, relative lateral and rotational movement, and limited bending of the lower pipe end portion whereby bending stresses are significantly relieved.

A still further object of the present invention is to disclose a marine riser pipe system wherein longitudinally spaced collar means are carried by end portions of the riser pipe for reception within a hawse or casing means and for providing longitudinally spaced fulcrum contacts with inner surfaces of the hawse pipe.

Generally speaking, this invention contemplates a marine riser system for an offshore floating platform adapted to be located over a well hole means wherein a riser pipe extends between said well means and said platform. The upper end portion of the riser pipe is received within elongated hawse means carried by the platform means and which extend between the platform deck and submerged horizontal buoyant members, the upper riser end portion being loosely slidably received within the platform hawse means and being provided with longitudinally spaced collar means for fulcrum contact with the hawse means. The lower riser end portion extends into the well casing and has longitudinally spaced collar means thereon providing fulcrum contacts with the well casing, the lower riser portion having relative axial movement, relative rotational movement, and relative lateral bending movement with respect to the well casing means. Adjacent to the submerged members of the platform means and adjacent to the well means, the riser pipe includes tapered riser pipe sections which facilitate control of bending stresses at that location.

Various other objects and advantages of the present invention will be readily apparent from the following description of the drawings in which an exemplary embodiment of my riser pipe system is shown.

IN THE DRAWINGS

FIG. 4 is a chart illustrating bending stresses imposed on a riser pipe system having a fixed support or connection as shown in FIG. 1 and being subject to typical conditions such as: horizontal offset of the platform over the vertical, horizontal oscilatory motion of the platform, wave excitation, and current force.

FIG. 5 is a similar chart showing bending stresses on a riser system of this invention connected to the seabed as shown in FIG. 2 under the same conditions as that in FIG. 4.

FIG. 10 is a table comparing the bending stresses of the fixed and non-fixed supports for each of the cases shown in FIGS. 6, 7, 8 and 9.

Figure 1:
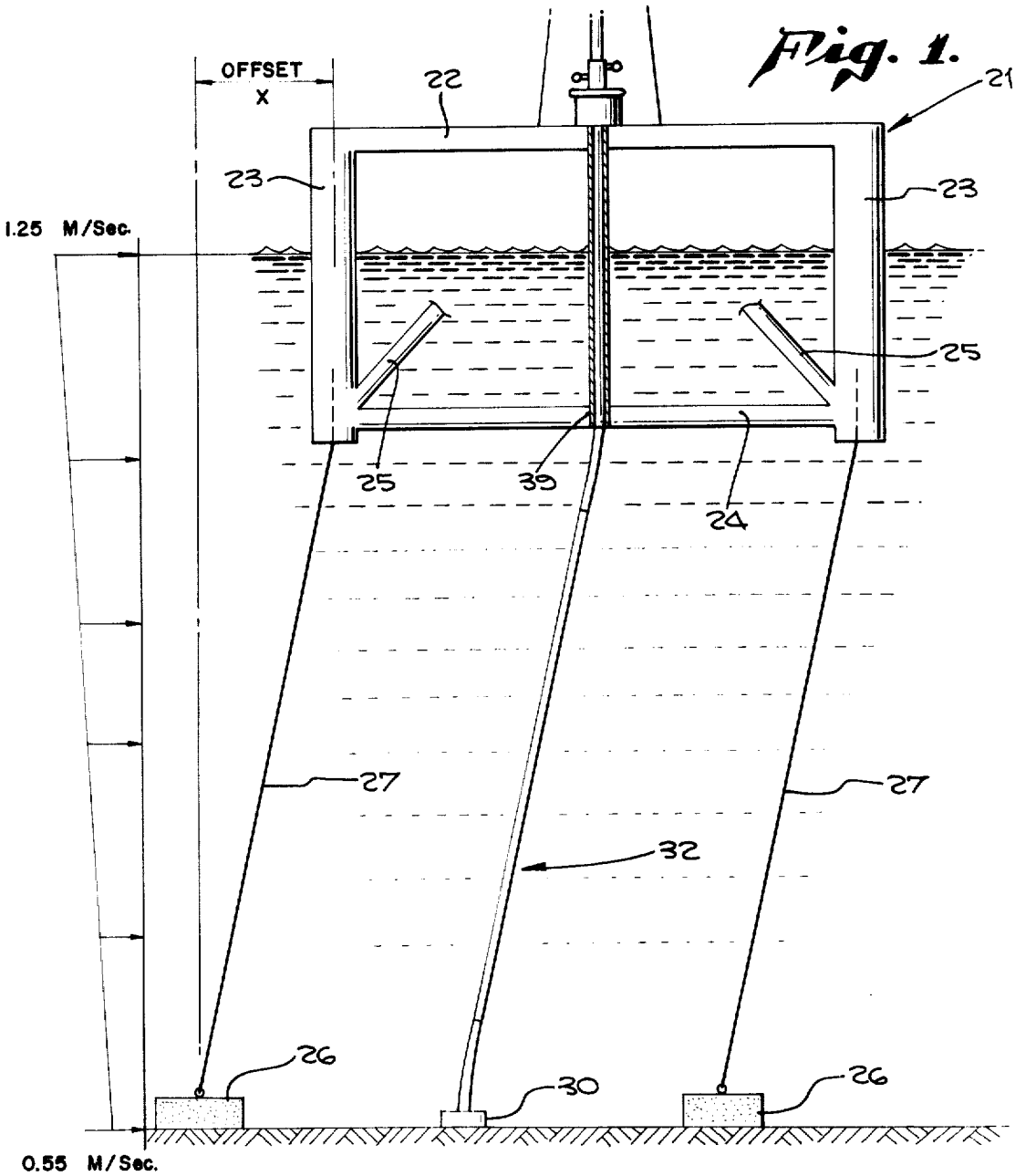
FIG. 1 is a schematic elevational view of a riser pipe system of the prior art in which the lower end of the riser pipe is fixed to the seabed and the upper end is slidably received at the offset platform.

Referring first to FIG. 1, a floating platform is generally indicated at 21 and may comprise a platform deck 22, vertical buoyant columns 23, and horizontal buoyant members 24. Diagonal columns 25 are partially illustrated. Other structural bracing of the platform means is not shown.

The platform 21 is connected to anchors 26 on the sea bottom by anchor lines 27, which are placed under suitable tension. The platform means 21 may be of the type disclosed in my U.S. Pat. No. 3,780,685 on a tension leg platform in which the displacement ratio of the buoyancy of the horizontal members to the total buoyancy of the platform is selected within a certain range in order to cancel and substantially neutralize vertical motion force components imparted to the platform by heave, pitch and roll of the platform response to wave conditions.

As indicated in FIG. 1, the platform is offset a distance X from its normal vertical position over the anchor means and the vertical axis of well means 30. At the left side of FIG. 1, a vector chart is illustrated showing the variation of water currents or current profile from the surface of the sea to the seabed.

A riser pipe system generally indicated at 32 has an upper end connected to platform 21 by a conductor or hawse member 39 extending from submerged horizontal member 24 for receiving and guiding the upper end portion of riser pipe means 32 to its termination at the platform deck 22 in a suitable production Christmas tree. Such connection of the upper riser end portion is nonrotatable relative to the platform and is axially movable relative to the platform. The uppermost end of the riser pipe system may be suitably connected to riser pipe tensioning means, as shown.

In this schematic illustration, the lower end portion of the riser pipe means 32 is terminated at the well means 30, usually at the wellhead and interconnected with the wellhead in well-known manner, usually a rigid connection; that is, non-rotatable and nonaxially movable relative to the wellhead. Some prior riser connections, both top and bottom, have included ball and swivel joints to permit some pivotal and rotational movement of the riser pipe means.

It will be understood by those skilled in the art that the relatively fixed connection of the lower end of the riser pipe means to the wellhead causes severe stresses in the lower end of the riser pipe caused by lateral and rotative forces acting at the wellhead. Compensation of vertical or axial forces imparted to the riser pipe system by vertical motion forces of the platform must be compensated by the riser pipe system and riser pipe tensioning means at the upper part of the riser pipe system. In some instances, the upper portion of the riser pipe system included relatively movable telescopic slip joint members to compensate for such vertical motion or axial force components acting on the riser pipe system.

Figures 2, 3:
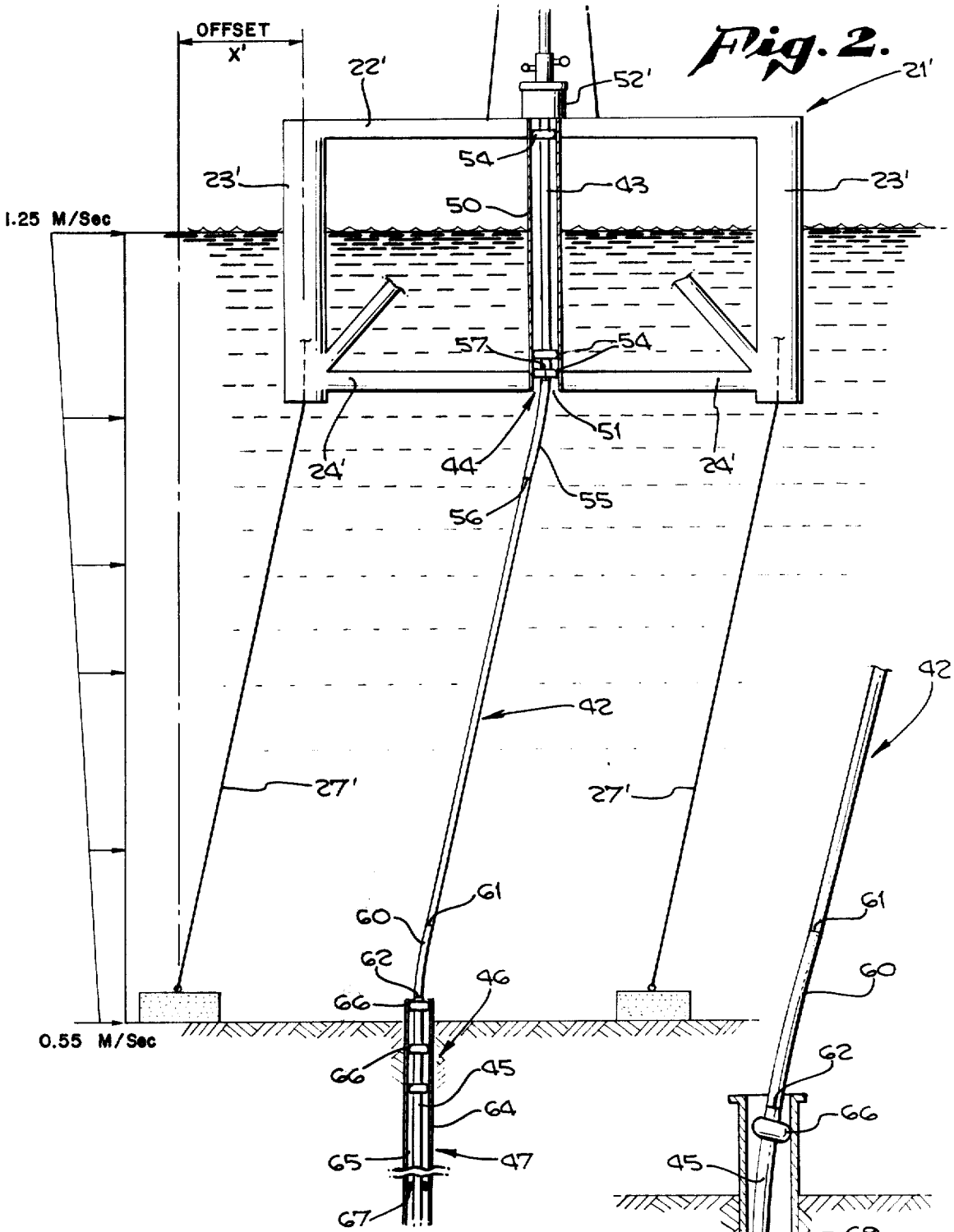
FIG. 2 is an elevational view of a riser pipe system in which each end of the riser pipe is provided with a novel connection embodying this invention, respectively to an offset floating platform and at the seabed.
FIG. 3 is a fragmentary enlarged sectional view of the novel riser pipe connection at the seabed under a typical bending condition.

In FIG. 2, a similar floating platform is generally indicated at 21'; like parts will be given like reference numerals, and only the differences relative to the present invention will be described in detail.

In FIG. 2, a riser pipe system 42 is provided with an upper portion 43 having a non-fixed connection 44 to the platform means 21' and a lower portion 45 having a non-fixed connection 46 to the well hole system, generally indicated at 47. The term "non-fixed" as used herein refers to the capability of the riser pipe end portions of moving within the hawse or casing pipe relatively freely laterally between fulcrums, rotatively at spaced fulcrum collars, and vertically with respect to the platform and to the well means 47, and with bending stresses reduced in the riser pipe.

Non-fixed connection 44 to the platform means comprises a hawse pipe 50 extending from submerged horizontal members 24' to platform deck 22'. Hawse pipe 50 may include a bottom opening 51 having a downwardly and outwardly flared configuration. Upper portion 43 of riser pipe 42 has an outer diameter smaller than the inner diameter of the hawse pipe, so as to provide an annular space therebetween. The upper end of riser pipe portion 43 may be connected to a platform tree, which may include suitable swivel connections to flowlines to avoid transmitting motion of the top end of the riser pipe to production equipment on the deck. A riser pipe tensioning means 52 may be suitable connected to the upper end of riser pipe portion 43 at deck 22'.

Non-fixed connection 44 also includes a plurality of axially or longitudinally spaced collars 54 carried by the upper end portion 43 of riser pipe 42, which is positioned within hawse pipe 50. Collars 54 have an outer diameter which is less than the inner diameter of the hawse pipe to provide relatively free longitudinal movement of upper portion 43 of the riser pipe within the hawse pipe. Collars 54 may be made of metal, such as steel and brass, and are preferably hard and not soft or resilient. Collars 54 may be secured to the riser pipe portion in suitable manner, as by welding. The outer surfaces of the collars may be convex and when in contact with the inner surfaces of the hawse pipe serve to provide fulcrum or pivotal engagement therewith. As relative movement occurs between platform 21' and riser pipe system 42, it will be apparent that the upper portion 43 of the riser pipe means 42 will move transversely between collars 54, rotatively at collars 54, and vertically with respect to the hawse pipe.

Usually, bending stresses of a riser pipe at its connection to the platform are critical and relatively great at the vicinity where the riser pipe connects to the platform means. The present invention contemplates that the riser pipe means at such location include a riser pipe section 55 of tapered section. For example, the riser pipe system 42 may have a constant inner diameter throughout its length and a constant outer diameter throughout its length until it approaches the floating platform. Adjacent the platform, riser pipe section 55 may have its outer diameter increased approximately 33% between the lower end of section 55 at 56 to the upper end of section 55 at 57 adjacent the lower end of the hawse pipe. From the upper end of tapered section 55, the upper riser pipe portion 43 may have a constant outer diameter.

The non-fixed connection 46 at the seabed and well means 47 is similar to connection 44. Above the seabed and at a selected distance therefrom, the lower end of the central riser pipe system 42 may be connected to a tapered pipe section 60 having an upper end at 61 and an enlarged lower end at 62, the pipe section 60 increasing in diameter in the same manner at that described for pipe section 55.

Instead of a wellhead or other fixed riser connecting means at the seabed, the lower end of the tapered section 60 is connected to a lower riser pipe portion 45, which extends downwardly into a well casing or hawse pipe 64 having an inner diameter greater than the outer diameter of the riser portion 45, so as to provide an annular space 65 therebetween. Along the length of the riser portion 45 may be provided axially or longitudinally spaced collars 66 which may be relatively loosely, fitted within the hawse pipe or well casing 64. The collars 66 may be similar in material and construction to collars 54 described above and may similarly engage inner surfaces of the casing means. At a selected depth within well casing 64, the lower riser pipe portion 45 may be packed off and a seal 67 provided between the well casing and the riser pipe portion. It will thus be apparent that the riser pipe portion 45 therebelow is capable of non-fixed movement in the well casing in lateral bending between collars 66, fulcruming against the casing at collars 66, and limited axial motion relative to the well casing.

When the floating platform 21' is offset laterally a number of feet from its normal vertical position, such offset varying for example from 0 to 75 feet or more, the riser pipe means 42 will be angularly disposed with respect to the axis of the well casing means 64 and also with respect to the axis of the hawse pipe 50 in the platform 21' as shown in FIG. 2. In FIG. 3, an exemplary exaggerated configuration of the lower riser portion 45 with respect to the casing 64 is illustrated. It will be noted that collars 66 in their axial spaced relation along the riser pipe portion 45 provide spaced contact or fulcrum locations where the collars 66 engage, first on one side and then on the other side, of the internal surface of the well casing 64 as the pipe bends. Since the lower riser pipe portion 45 is free to bend at 69 and then reverse bend at 70 therebelow, it will be apparent that bending stresses imposed upon the lower portion of riser pipe means 42 are reduced, particularly at the seabed.

A comparison of the effect of a riser having fixed connections as shown in FIG. 1 and a riser having non-fixed connections as shown in FIG. 2 is given below. In this comparative example, riser 32 of FIG. 1 has both ends fixed in their connection respectively to the floating platform and to the seabed. In FIG. 2, riser 42 has its ends non-fixedly connected to the well means at the seabed and to the floating platform by having the riser pipe continue for a preselected length into the hawse pipe of the platform and into the well casing of the wellhead. In each figure, the riser has an inner diameter of 3.826 inches, an outer diameter throughout most of its length of 4.5 inches and the outer diameter of the riser increases from 4.5 inches to 8 inches over tapered lengths of 105 feet at the upper end, to 6.5 inches over tapered lengths of 60 feet at the lower end. In FIG. 2, the riser sections above the submerged horizontal members and below the sea floor are protected from current and wave loadings by hawse pipes and the well casing. An exemplary hawse pipe inner diameter may be 16 inches; the well casing may also be 16 inches inner diameter or other suitable diameter. Collars 54 and 66 may have about 15½ inches or less outer diameter where hawse pipe and well casing are 16 inches inner diameter.

In the analysis, as conducted in a computer program, constants used are

Figure 6:
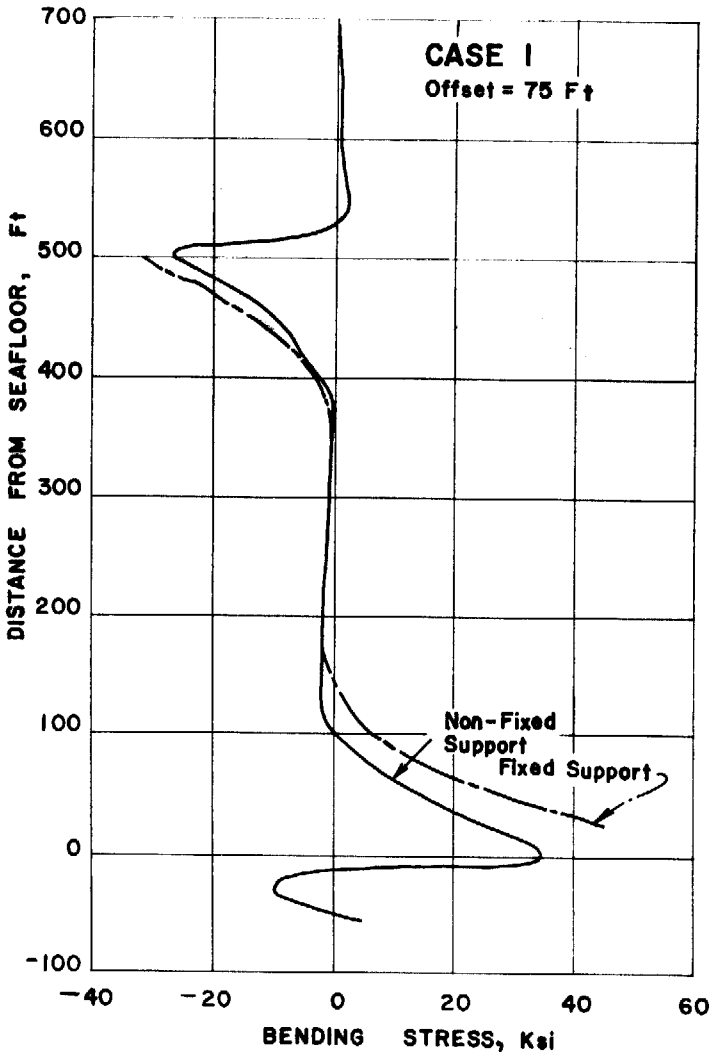
FIG. 6 is a chart comparing bending stresses of a fixed support and a non-fixed support of this invention under conditions imposed by offsetting of the platform relative to the seabed.
Figure 9:
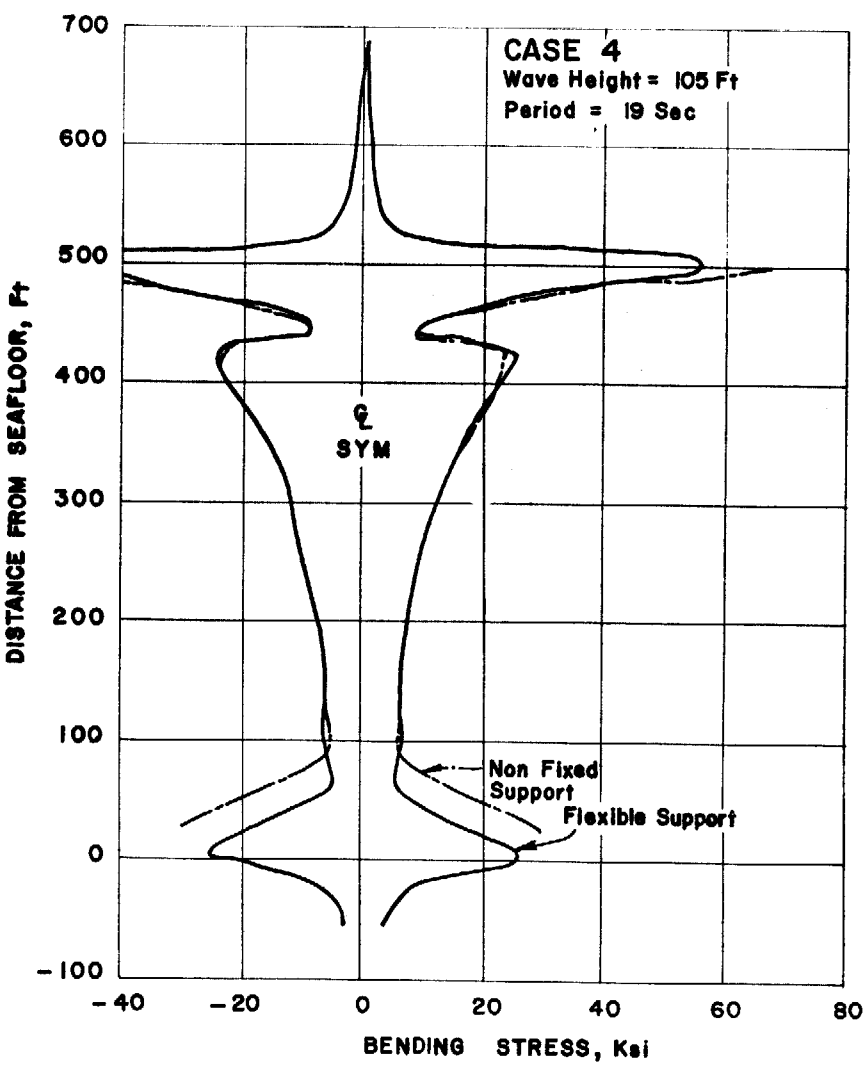
FIG. 9 is a chart similar to charts in FIGS. 6, 7 and 8 comparing bending stresses of a fixed support and a non-fixed support under conditions imposed by wave forces.

1. Young's modulus of the riser pipe $=30\times10^6$ psi
2. Unit weight of riser pipe $=490$ lbs/ft$^3$
3. Unit weight of sea water $=64$ lbs/ft$^3$
4. Drag coefficient $=1$
5. Added mass coefficient $=1$ In the example, four loading cases are considered as set out below 1. Platform offset $=75$ ft.
2. Platform offset $=75$ ft.
   Current-0.55 M. per second at the sea floor
   1.25 M. per second at surface
3. Surge $=\pm40$ ft. Period $=19$ seconds
4. Wave height $=105$ ft. Period $=19$ seconds In FIG. 6 bending stress on the riser is shown for the offset loading case 1 above. As shown in FIG. 10, the bending stress at the sea floor for the fixed support is 44.7 ksi and for the non-fixed support 34.8. Beneath the sea floor the bending stress of the riser 42 decreases to a negative 9.6 ksi and then at the bottom of the riser and at about 60 feet below sea floor, the bottom end of the riser has a stress of about plus 4.7 ksi. Over the major length of the riser 42, a slightly negative bending stress is seen in FIG. 6. As the stress lines approach the bottom of the platform, the bending stress of riser 32, a fixed connection, is about 33.1 (FIG. 9). The bending stress at the bottom of the pontoon for riser 42 is about 26.8. Above the pontoon the riser 42 follows a somewhat similar configuration to its bottom riser portion in that it decreases to zero bending stress and then passes slightly beyond to about 2 ksi. The stress line then decreases to zero at the upper end. It will be apparent from consideration of FIG. 6 that bending stresses at the ends of riser 42 and where the ends may be connected to other well equipment are relatively small. More importantly, the difference between the bending stress at the sea floor between the two riser end connections is substantial; namely, at the sea floor a differential of 9.9 ksi and at the bottom of the pontoon or floating platform 6.3 ksi.

Figure 7:
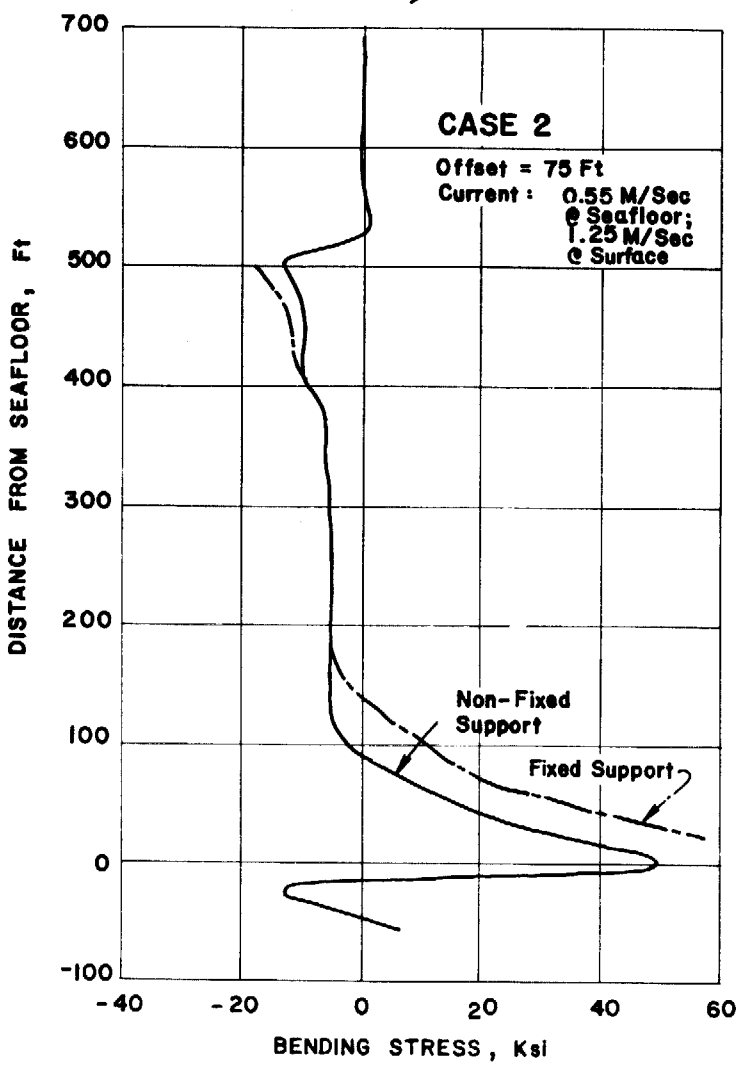
FIG. 7 is a chart similar to FIG. 6 comparing bending stresses of a fixed support and a non-fixed support of this invention which result from ocean currents acting along the height of the riser pipe and offsetting of the platform relative to the seabed.

A comparison of the loading in the second loading case; FIG. 7 that is, where the platform is offset 75 ft. and the wave current is as stated above varying from 0.55 M. per second at the sea floor to 1.25 M. per second at surface. In this loading case, which involves the effect of the wave currents on the riser, the bending stress of the fixed support at the sea floor is 56.3 (FIG. 10) and the non-fixed connection 44.8. At the bottom of the pontoon, the bending stress of the fixed support is 18.4 ksi and of the non-fixed support 13.3 ksi. Again, it should be noted that the bending stresses at points of connection of the riser 42 to other equipment is minimal.

Figure 8:
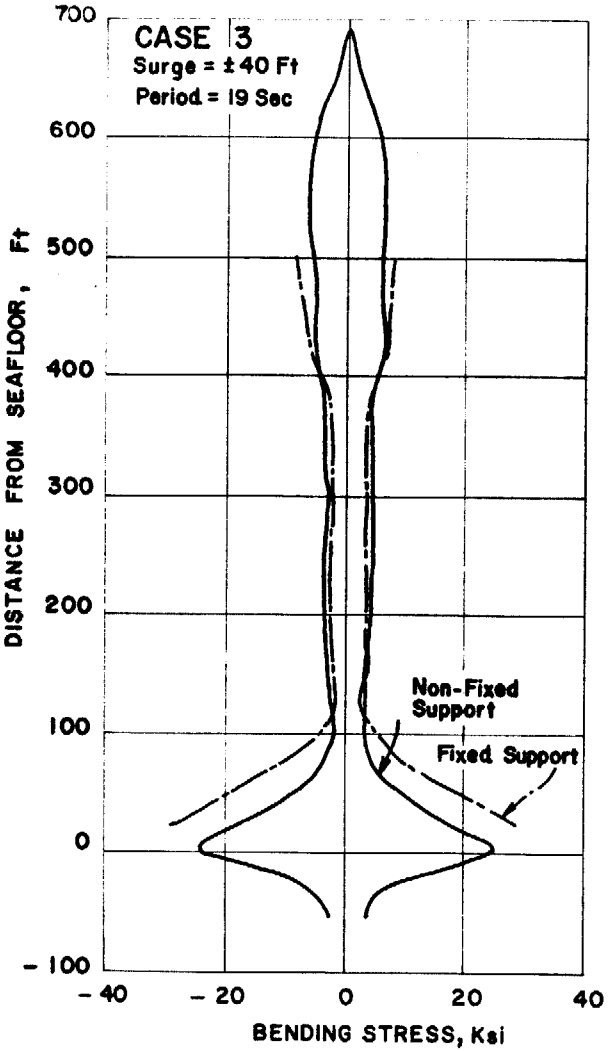
FIG. 8 is a chart similar to charts in FIGS. 6 and 7 illustrating bending stresses of fixed and non-fixed supports imparted to the riser pipe section due to surge motion of the platform.

In FIG. 8, loading case 3 illustrates the bending stress under the above-identified surge condition. At the sea floor, the bending stress of the fixed support is 28.5 and of the non-fixed support 25 ksi. At the bottom of the pontoon, the bending stress of the fixed support riser 32 is 8.1 and of the non-fixed support riser 42 the bending stress is 4.5 ksi.

Bending stresses along both risers under 105 ft. wave height conditions of loading case 4 are shown in FIG. 9. At the sea floor the bending stresses of the fixed support is 32.9 ksi and of the non-fixed support 26 ksi. At the bottom of the pontoon, the bending stress of the fixed support riser 32 is 67 ksi and of the non-fixed support riser 42 the bending stress is 57 ksi.

A consideration of FIG. 10 clearly indicates that the bending stress in riser 42, which has non-fixed connections of this invention at the platform and at the sea floor, is always less than the bending stress of riser 32, which has fixed connections at the floating platform and at the sea floor.

Another comparative example of the bending stress of the fixed and non-fixed end connected risers is shown in FIGS. 4 and 5. In this example, the platform offset was 55 ft., the current profile was 1.25 M. per second at the surface and 0.55 M. per second at the sea floor; the platform motion was plus or minus 43.2 ft. at a 19 second period, wave had a 105 ft. height at a 19 second period and the phase angle was 86.5° . In FIG. 4 maximum stress values along the riser pipe is indicated at 71.4 ksi for the fixed end at the seabed; and in FIG. 5, the corresponding bend stress for the non-fixed connection was 56 ksi. In addition, relative vertical motion between riser and platform in the fixed end condition (FIG. 1) was 1.7 ft. as compared to the relative vertical motion of the non-fixed end (FIG. 2) of 1.0 ft.

With respect to the difference in relative vertical motion between the fixed end connection and the non-fixed end connection of risers, it should be noted that when platform 21, FIG. 1, moves into a horizontally offset position the platform will move downwardly relative to the seabed. The distance between the bottom of vertical columns 23 of the platform and the seabed decreases because of the parallelogram type of lateral movement of the tension anchor lines of the platform means with respect to the seabed. In addition, there is relative change in length between the anchor lines 27 and the length of riser pipe means 32, which has fixed connections at its ends.

In the riser arrangement having non-fixed connections as shown in FIG. 2, the change in length of the riser pipe means 42 as measured from its point of entry into the submerged part of the platform to the point of entry into the well casing means at the sea floor is minimized because of the capability of the lower portion of the riser means to move vertically, laterally and rotatively with respect to the well casing. Moreover, at the platform the upper end portion of the riser pipe 42 extends into the hawse pipe and is also afforded vertical, lateral and rotative movement relative to the hawse pipe. Thus, under conditions of relative vertical movement between the floating platform and the seabed, it will be apparent that a riser, such as riser pipe 42, which has its upper and lower ends non-fixedly received within hawse or well casing means, is suitable to be adapted to yield to such relative change in depth of the floating platform without inducing critical severe stresses in the riser pipe.

Riser pipe means 42 may include riser pipe arrangements of well-known form. A preferred example of a riser pipe 42 for use with the non-fixed connections of this invention comprises a riser pipe provided with a plurality of longitudinal buoyant sleeve members or jackets which are arranged to give the riser pipe slightly negative buoyancy. Slightly negative buoyancy means that the displacement of the riser pipe in water, the weight of the pipe, the weight of the fluid therein, will almost support the riser pipe in the water. Such support, together with selected means for tensioning the riser pipe at the platform, will maintain the riser pipe upright and will prevent its collapse.

The advantages of the riser pipe system of the present invention will be readily apparent to those skilled in the art. The projection of the riser pipe end portions with spaced collars into the hawse means of the platform and into the casing means of the well for substantial distances of, for example, from 30 to 90 feet affords significant reduction in bending stresses at the seabed and at the bottom of the platform, which reduction in bending stresses have not been heretofore achieved.

The construction of the riser pipe with a uniform inner diameter throughout its length, enlarged riser end portions of uniform outer diameter, and elongated tapered riser sections connecting the end portions to the intermediate riser portion serves to cooperate with the larger inner diameter hawse pipe means to permit such relative movement therebetween as to provide a virtually non-fixed connection. It will be understood that in some instances the cooperative non-fixed relationship between riser end portion and hawse means may be utilized at only one end of the riser system to achieve reduction in bending stresses, as for example, when associated with an existing wellhead.

Modifications and changes in the marine riser pipe system described above which fall within the spirit of this invention and which come within the scope of the appended claims are embraced thereby.

I claim:

1. In a marine riser system for conducting fluid between a platform and a well means in a seabed formation and for minimizing stresses in said riser system, the combination of:

a riser pipe having an upper riser portion and a lower riser portion;

a hawse pipe fixed on said platform and extending from a production deck to a submerged platform member and receiving said upper riser portion;

a hawse pipe at said well means extending into said seabed formation for a selected distance and receiving said lower riser portion;

and means non-fixedly connecting said upper and lower riser portions to their respective hawse pipes including fulcrum members on each of said upper and lower riser portions, the fulcrum members on each riser portion being separated a selected distance to permit bending of the pipe portion between said separated fulcrum members and being loosely fitted within said hawse pipes for axial, lateral, and rotational relative movement with respect thereto.

2. In a system as claimed in claim 1 wherein said upper and lower riser pipe portions having within said hawse pipes increased metal thickness with respect to the metal thickness of the intermediate portion of the riser pipe extending between said platform and said well means.

3. In a system as claimed in claim 2 wherein said hawse pipes have inner diameters greater than outer diameters of said riser pipe portions to provide annular spaces therebetween, said annular spaces providing space for lateral and bending movement of said pipe portions between said fulcrum members as a result of bending stresses imposed on said riser pipe.

4. Means for connecting one end portion of a riser pipe to a hawse pipe associated with a support means for reduction of stresses in said riser pipe, comprising:

said hawse pipe being immovable relative to the support means and having a uniform inner diameter for substantially the length of the hawse pipe greater than the outer diameter of the riser pipe end portion to provide an annular space therebetween;

said riser pipe end portion being received in said hawse pipe for a substantial length;

and spaced apart fulcrum elements carried by said riser pipe portion in said annular space and loosely fitted with respect to said hawse pipe for providing a non-fixed connection of said riser pipe end portion to said hawse pipe for axial, lateral, and rotational movement of the riser end portion relative to the hawse pipe to minimize stresses in said riser pipe.

5. In a marine riser system for conducting fluid between a floating platform and a well means in a seabed formation, the combination of:

a generally vertically disposed riser pipe;

means for connecting said riser pipe to a floating platform;

means for connecting said riser pipe to well means at said seabed formation below said floating platform;

at least one of said connecting means including a fixed hawse pipe;

said one of said connecting means being a riser pipe portion extending into its associated hawse pipe for the length of said hawse pipe and having fulcrum means on the riser pipe portion within and adjacent to each end of said hawse pipe in non-fixed relation with respect to the axial, lateral, and rotational movement of said riser pipe portion within said hawse pipe.

6. In a marine riser system for conducting fluid between a platform and a well means in a seabed formation and for minimizing stresses in said riser system, the combination of:

a riser pipe having an upper riser portion and a lower riser portion;

a hawse pipe on said platform extending from a production deck to a submerged platform member;

a hawse pipe at said well means extending into said seabed formation for a selected distance;

and means for nonfixedly connecting said upper and lower riser portions to their respective hawse pipes including longitudinally spaced means on said respective riser portions within said hawse pipes for axial, lateral, and rotational relative movement with respect thereto;

said upper and lower riser pipe portions being joined with the intermediate portion of said riser pipe by elongated tapered sections of said riser pipe.

7. In a marine riser system for conducting fluid between a floating platform and a well means in a seabed formation, the combination of:

a generally vertically disposed riser pipe;

means for connecting said riser pipe to a floating platform;

means for connecting said riser pipe to well means at said seabed formation below said floating platform;

at least one of said connecting means being a non-fixed connection with respect to rotational movement of said riser pipe;

said one connecting means including an elongated hawse pipe having an inner diameter greater than the outer diameter of said riser pipe received therewithin to provide an annular space between said hawse pipe and said riser pipe, and longitudinally spaced fulcrum contact means in said annular space between said hawse pipe and riser pipe and providing relative axial, lateral, and rotational movement of said riser pipe;

said riser pipe portion received within said hawse pipe having an enlarged diameter with respect to riser pipe portions external of said hawse pipe;

and an elongated tapered riser pipe portion between said external riser pipe portion and said enlarged portion of said riser pipe within said hawse pipe.

8. In a marine riser system for conducting fluid between a tension leg platform and a well means in a seabed formation, said platform being anchored to the seabed formation by tension legs and having minimal relative vertical movement with respect to said seabed formation; the combination of:

a hawse pipe means secured in fixed relation to said platform;

a riser pipe means extending from said well means to said platform and including an upper riser portion of selected diameter received within said hawse pipe means, a riser pipe portion of less diameter extending for the major portion of the length between said platform and said well means, and a tapered riser portion interconnecting said latter riser portion and said upper riser portion;

and fulcrum means provided in the annular space between said upper riser portion and said hawse pipe means, said fulcrum means being located adjacent said platform deck and adjacent the lower end of said hawse pipe means and whereby said upper riser portion between said fulcrum means may laterally bend and rotate about said fulcrum means.

9. In a marine riser system as stated in claim 15 including a hawse pipe means in said seabed formation;

a lower riser portion of selected diameter extending within said last mentioned hawse pipe means;

a tapered riser portion interconnecting the lower riser portion and the major riser portion extending upwardly to the platform;

and spaced fulcrum means provided in the annular space between said last mentioned hawse pipe means and the lower riser portion whereby the lower riser portion between said bottom spaced fulcrum means is adapted to laterally bend and to fulcrum about said fulcrum means.

* * * * *